United States Patent [19]

Pizzurro

[11] Patent Number: 4,537,370

[45] Date of Patent: Aug. 27, 1985

[54] OPTICAL GROWTH COMPENSATOR

[75] Inventor: Vito F. Pizzurro, Villa Park, Calif.

[73] Assignee: Ford Aerospace & Communications Corporation, Detroit, Mich.

[21] Appl. No.: 548,183

[22] Filed: Nov. 2, 1983

[51] Int. Cl.[3] ..... F41G 7/22

[52] U.S. Cl. ..... 244/3.16

[58] Field of Search ..... 244/3.16, 3.15, 3.17

[56] References Cited

U.S. PATENT DOCUMENTS

| | | | |
|---|---|---|---|
| 3,943,277 | 3/1976 | Everly et al. | 178/6.8 |
| 4,106,726 | 8/1978 | Emmons et al. | 244/3.17 |
| 4,112,294 | 9/1978 | Pressiat | 250/203 |
| 4,133,004 | 1/1979 | Fitts | 244/3.16 |
| 4,162,775 | 7/1979 | Voles | 244/3.17 |
| 4,168,813 | 9/1979 | Pinson et al. | 244/3.16 |
| 4,174,818 | 11/1979 | Glenn | 244/3.16 |
| 4,227,077 | 10/1980 | Hopson et al. | 250/203 |
| 4,314,761 | 2/1982 | Reymond et al. | 244/3.16 |
| 4,465,940 | 8/1984 | Graff et al. | 244/3.16 |

OTHER PUBLICATIONS

"Terminal Homing Applications of Solid-State Imaging Devices (THASSID) Composite Tracking Concepts", by J. H. Pridgen, W. W. Boyd, W. C. Choate & E. E. Mooty; SPIE vol. 186, Digital Processing of Aerial Images, 1979.

*Primary Examiner*—Charles T. Jordan

*Attorney, Agent, or Firm*—Edward J. Radlo; Harry G. Weissenberger; Robert D. Sanborn

[57] ABSTRACT

A moving target detector for spinning bodies such as projectiles or missiles uses a linear detector array so mounted on the body as to periodically scan an arcuate target area during the spin of the body. Compensation for the resulting optical growth of the target area image as the body approaches the target is accomplished by serially reading the image information from the detector elements (in a direction radial of the target area) into a delay element chain at a variable rate, and dumping the delay chain contents in parallel into the image memory at a fixed rate. The readout rate variation is pre-programmed prior to launch, and feed-back loop may be provided to adjust the rate if the image evaluation circuits detect apparent radial movement of evidently stationary objects near the target.

10 Claims, 6 Drawing Figures

OPTICAL GROWTH COMPENSATOR

FIELD OF THE INVENTION

This invention relates to optical growth compensating devices for moving target acquisition from a spinning body such as a projectile, particularly to a self-contained system of this type which is simple enough to be fully contained on the body itself.

BACKGROUND OF THE INVENTION

Devices for identifying targets and directing a missile toward those targets are well-known. Basically, the conventional devices of this type fall into two categories:

1. Devices in which the missile itself detects, and zeroes in on, a source of energy such as heat or magnetic disturbance, and
2. devices in which the missile is guided by remote control to a target in accordance with target information detected by an independent target-identifying apparatus.

In the latter type of device, the target area is generally evaluated by a scanning system mounted on an aircraft or the like. The system observes the target area, calculates the apparent displacement of stationary objects in the field of view between successive scans, compares successive displacement-compensated scans, and by a subtraction process identifies targets which fail to conform to the predicted pattern of apparent movement of stationary objects. Because of the nature of the motion of an aircraft, the size of the target area seen by the scanner remains essentially constant throughout the target acquisition interval, so that the only correction which needs to be made is the correction for linear position changes along the path of the aircraft.

A totally different situation arises if the detection device is to be mounted directly within a projectile or small missile in which cost and space factors are predominant. Due to the nature of the trajectory of the projectile in travelling toward a target, the image of the target area as seen by a detector on the projectile appears to expand radially outward from a central point. The use of conventional computational methods in compensating for this type of motion requires apparatus too bulky and expensive for use in a projectile. For this reason, it has heretofore been impractical to mount self-contained moving target detectors directly within a projectile. This is particularly true for infrared detectors which inherently have low resolution and require a substantial number of frames to detect target movement.

PRIOR ART

Representative types of prior art tracking and guidance systems are discussed in U.S. Pat. No. 4,106,726 (Emmons et al); the article "THASSID composite tracking concepts" by Pridgen et al, Proceedings of the Society of Photo-Optical Instrumentation Engineers, Vol. 186, pp. 73–87 (1979); U.S. Pat. No. 4,168,813 (Pinson et al); U.S. Pat. No. 4,227,077 (Hopson et al); U.S. Pat. No. 3,943,277 (Everly et al); U.S. Pat. No. 4,112,294 (Pressiat); and U.S Pat. No. 4,162,775 (Voles). None of these references, however, disclose or suggest the economical solid-state system of this invention in which the projectile's spin is used to provide an arcuate target area scan, and optical image growth in that scan is compensated by the simple expedient of reading radial scan lines at variable rates.

SUMMARY OF THE INVENTION

The invention provides a practical projectile-mounted target detector using the projectile's inherent spin to scan the target area, and using a detector array with a variable readout clock to compensate for the optical growth of the image caused by the motion of the projectile toward the target.

More specifically, the invention provides an optical sensor including a plurality of linear detector arrays mounted radially in the nose of the projectile. Individual arrays are successively activated to scan the target area in response to an orientation signal from a geomagnetic sensor aboard the projectile. Each array is enabled to receive information only whenever it is in position to see the target area. The charge acquired by each element of the detector array during a scan increment is transferred to an individual charge-coupled device of a CCD bank, and the CCD bank is then read out serially at a clock rate determined by an on-board microprocessor while the detector array goes through the next scan increment. The readout rate is varied from frame to frame, in accordance with the range to the target, so as to compensate for the optical growth of the image as the projectile approaches the target. Originally, the range is determined on the basis of precalculated trajectory information supplied to the projectile's microprocessor prior to launch. Once the system of this invention becomes operational in flight, the coarse precalculated range information can be fine-tuned or corrected in a feed-back loop by actual target area observation.

As soon in the course of the trajectory as the detector arrays are able to see the projected impact area, acquisition is made of three large (and therefore presumably stationary) objects near the projected impact point. The readout rate variation based on the pre-programmed range information causes the position of these objects to remain stationary in the recorded image from frame to frame. Any apparent movement of these objects between time-spaced frames can be used to correct the pre-programmed range information.

The CCD data, beginning with the data from the radially outermost detector element, is serially applied to a delay line (e.g. a fixed-clock, serial-in, parallel-out shift register)consisting of a chain of fixed delay elements. Each delay element output is operatively connected to one byte of a polar-coordinate $(R,\theta)$ image memory along a constant $-\theta$ line. As the projectile's range to the target closes, a given object will be seen by progressively more radially outward detector elements.

At first the central portion of the CCD bank is read out slowly. When the delay line contents are dumped into the image memory at a fixed time following the last CCD readout, the data from, e.g., detector element outwardly next to the center element will just have reached the end of the delay line. This detector element may be seeing one of the stationary reference objects. Toward the end of the target acquisition period, the same object may be seen by the radially outermost detector element. At that time, the entire CCD bank is read out fast enough that the data from all the detector elements just fills the entire chain at the moment of dump. Thus the image of this reference object is always stored in the last byte of the image memory, and the object therefore appears to the interpretation circuitry to be stationary.

The evaluation of the image memory data by frame-to-frame comparison for target identification and tracking is conventional and forms no part of this invention.

FIGS. *2a* and *2b* are partial front and side elevations, respectively, of a projectile illustrating the positioning of the optical and geomagnetic sensors on the projectile.

Figure 3:
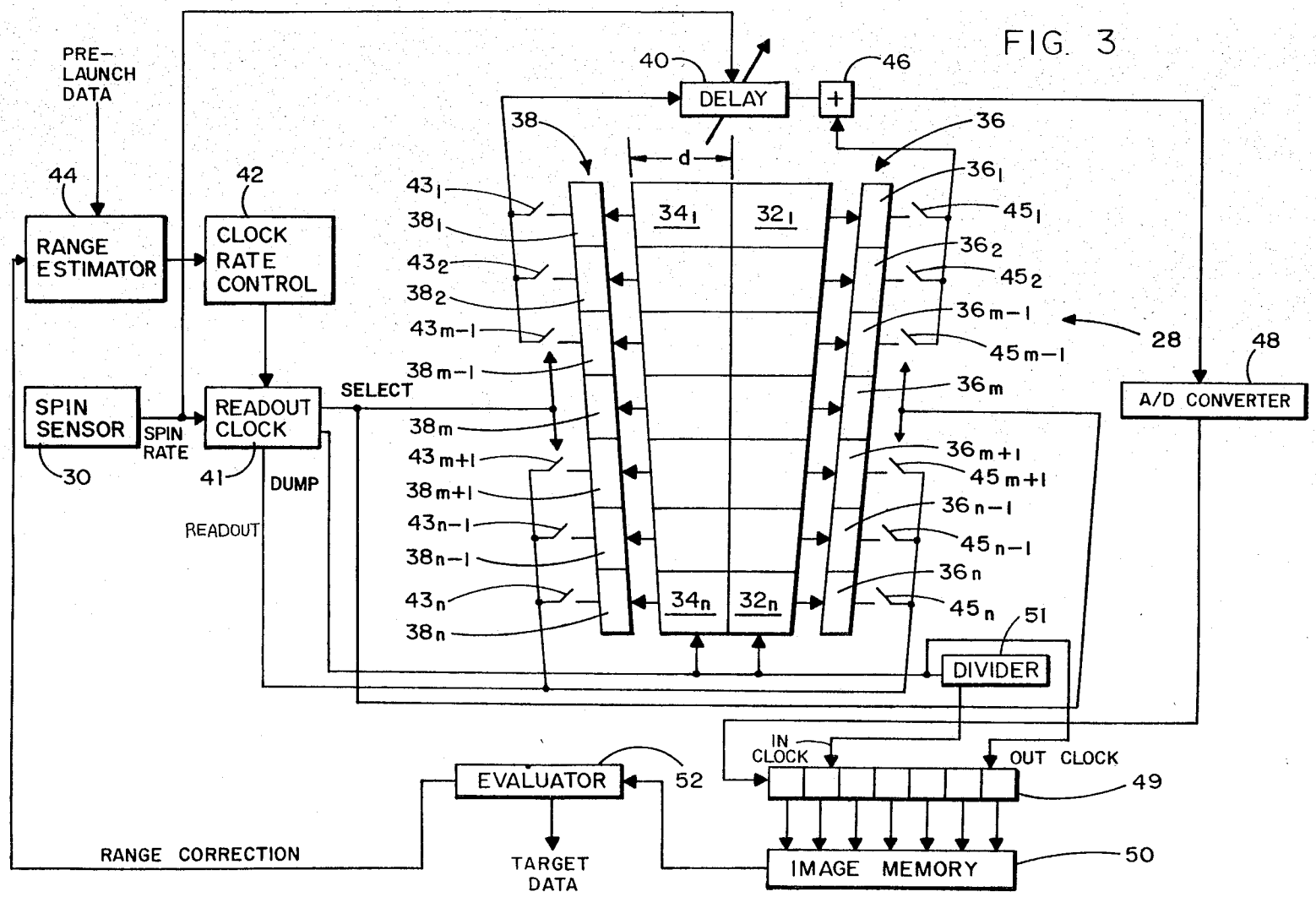
Figure 4:
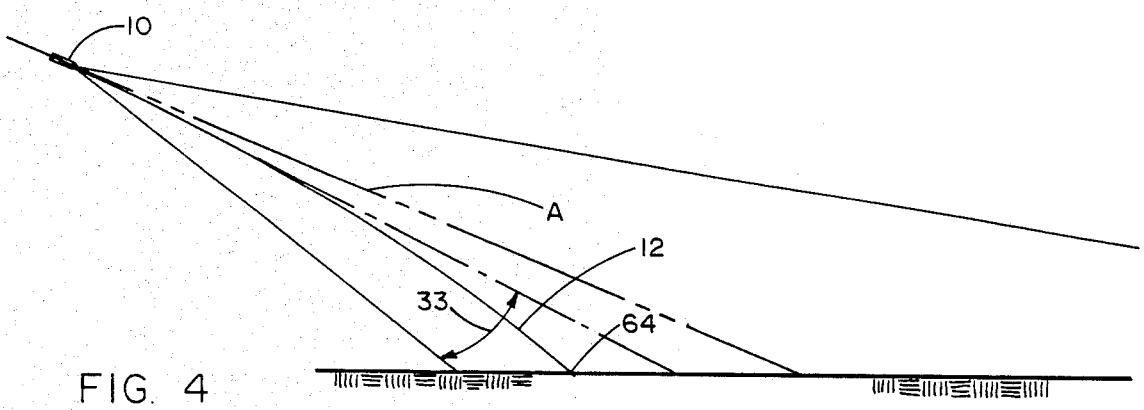
Figure 5:
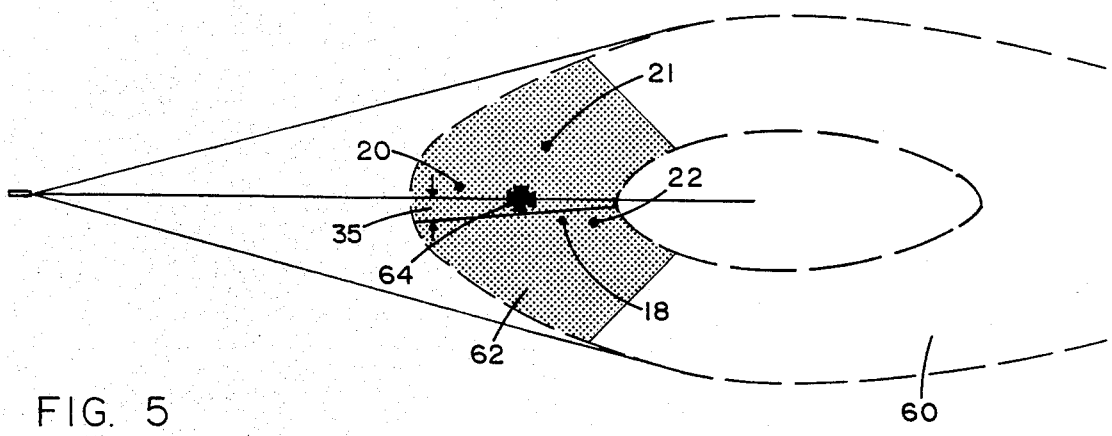

FIG. 3 is a schematic plan view of an individual detector array and of the CCD bank associated therewith; and FIG. 4 and FIG. 5 are elevational and plan views, respectively, illustrating the scan of the target area.

DESCRIPTION OF THE PREFERRED EMBODIMENT

Figure 1:
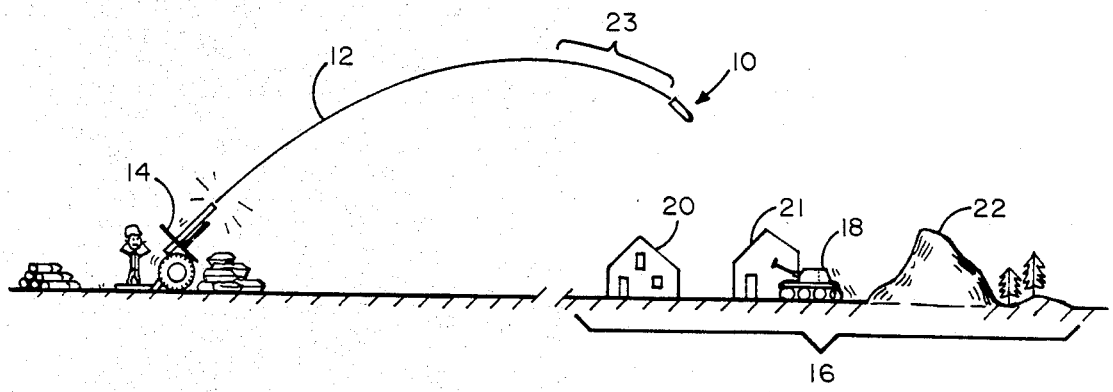
FIG. 1 is a schematic elevational view of a typical projectile trajectory and target area.

FIG. 1 illustrates a projectile 10 travelling along a trajectory 12 between a launching device 14 and a target area 16 containing a moving target 18 and a plurality of large stationary infrared energy sources such as buildings 20, 21, or a terrain feature 22. The target acquisition by the system of this invention is preferably performed in the region 23 of the trajectory 12, when the projectile's range to the target is on the order of 1–2 km.

Referring to FIG. 2, the projectile 10 inherently spins about the axis A as indicated by arrow 24. After launch, and prior to reaching the trajectory portion 23, the nose cone 26 of projectile 10 (which may contain the coolant supply for the optical sensor 27) is jettisoned, exposing the optical sensor 27 with its detector arrays 28. The projectile 10 has also mounted therein a geomagnetic sensor 30 which provides a generally sinusoidal orientation signal as the missile spins about axis A.

As will best be seen in FIG. 3, each detector array 28 preferably (mainly for signal-to-noise improvement reasons) consists of a plurality of pairs of generally trapezoidal detector elements $32_1$ through $32_n$ and $34_1$ through $34_n$. Each of the detector elements 32 is connected to a corresponding charge-coupled device $36_1$ through $36_n$ or $38_1$ through $38_n$ of the CCD banks 36, 38. The pixel intensity information collected by detector elements 32, 34 is dumped in parallel into the corresponding CCDs 36, 38, respectively, once in each line interval. The line interval is dependent upon the spin rate, and corresponds to the time required for the detector array to traverse its angular field of view d (FIG. 3). The CCD banks 36, 38 are read out serially just prior to the parallel dump.

The signal from the leading CCD bank 38 is delayed through an appropriate variable delay circuit 40 responsive to the spin rate so as to produce target signals coincident in time with the signals from CCD bank 36 (whose corresponding detectors 32 scan any given target slightly later than the detectors 34), depending on the spin rate of the projectile.

Following each dump of the detector elements 32, 34 into the CCD banks 36, 38, the CCD banks 36, 38 are read out at a variable rate by the clocking circuit 41. The total readout time equals the interval between two dumps and is therefore constant. At the fastest readout rate, all the CCDs $36_1$ through $36_n$ and $38_1$ through $38_n$ are read out during that interval, while at the slowest rate the interval provides only enough time to read out the centermost CCDs $36_{m-1}$ through $36_{m+1}$ and $38_{m-1}$ through $38_{m+1}$.

Consequently, the clocking circuit 41 not only sets the dump interval under the control of the spin sensor 30, and the readout rate under the control of clock rate control 42, but also selects the detector elements to be read out. This is done by electronic switches $43_1$ through $43_n$ and $45_1$ through $45_n$. At the slowest readout rate (i.e. at the beginning of the target acquisition period), switches $43_{m-1}$, $45_{m-1}$, $43_{m+1}$ and $45_{m+1}$ are closed. At that time, only CCDs $36_{m-1}$ through $36_{m+1}$ and $38_{m-1}$ through $38_{m+1}$ are clocked out into shift register 49.

At the fastest readout rate (i.e. at the end of the target acquisition period), switches $43_1$, $45_1$, $43_n$ and $45_n$ are closed. At those switch settings, all the CCDs $36_1$ through $36_n$ and $38_1$ through $38_n$ are clocked out into shift register 49. It will be noted that in either event, the center CCDs $36_m$, $38_m$ of the CCD banks 36, 38 are read out in the center of the dump interval.

The clocking rate of the circuit 41 is determined by a clock rate control 42, which is controlled in turn by a range estimator circuit 44. The range estimator 44 is provided with the expected trajectory information for the projectile prior to launch and can be adjusted in flight as a result of the scanning information gathered by the projectile, in a manner hereinafter described.

The analog pixel signals read out from CCD banks 36 and 38 are added in an adder 46 and may then be converted into digital pixel bytes in analog-to-digital converter 48. The pixel bytes are then serially gated, through a shift register 49, which functions essentially as a multi-increment, non-variable delay line for the information readout of the CCD banks 36, 38. The number of elements in shift register 49 is preferably, though not necessarily, equal to n. It is basically dictated by the range of apparent movement of significant objects in the expanding image during the target acquisition period.

To illustrate the operation of shift register 49, let it be assumed that $n=7$ (as shown in the drawings). If the "in" clock of register 49 has a pulse rate of n times the dump rate, and the slowest readout rate is such, for example, that three "in" clock pulses occur between each readout pulse, the next dump of the shift register 49 into the image memory 50 will find the combined information from CCDs $36_{m-1}$ and $38_{m-1}$ in the rightmost byte of shift register 49 in FIG. 3, the information from CCDs $36_m$ and $38_m$ in the middle byte, and the information from CCDs $36_{m+1}$ and $38_{m+1}$ in the leftmost byte of shift register 49. Divider 51 produces the "in" clock from the dump clock.

If the fastest readout pulse rate is equal to the "in" clock pulse rate of register 49, the next dump of register 49 will find the information from the seven CCD pairs $36_1$, $38_1$ through $36_n$, $38_n$ in sequence in the seven bytes of register 49, with $36_1$, $38_1$ being on the right and $36_n$, $38_n$ being on the left in FIG. 3. Thus if the expected impact point of the projectile forms the center of the target area and is always represented by the central CCDs $36_m$, $38_m$, then a stationary object near the impact point might be represented by CCDs $36_{m+1}$, $38_{m+1}$ at the beginning of the target acquisition period, but by CCDs $36_n$, $38_n$ at the end of the target acquisition period due to optical image growth as the projectile approaches the target area. Yet due to the variable readout rate of the CCDs, the image value of that object will be stored in the leftmost byte of the image memory 50 both at the beginning and at the end of the target acquisition period.

After the final pixel byte from a readout has entered the shift register 49, the register 49 is dumped in parallel into the digital image storage memory 50. The dumping of register 49 is spin-rate dependent and is preferably coincident with the dumping of detector arrays 32, 34. The memory 50 is a polar-coordinate memory which may be capable of containing two or more frames of the image for comparison purposes.

As described above, the range-dependent variable readout rate of the CCD banks 36, 38, when combined with the spin-rate-dependent dumping rate of shift register 49, causes the pixel byte corresponding to a stationary object to be stored in the same image memory byte in each successive frame. Time-spaced stored frames can therefore be subtractively compared in a conventional evaluation device 52 to eliminate stationary objects and identify moving targets for conventional projectile guidance purposes. Conversely, apparent radial movement of selected stationary reference objects evaluated as such by their size and informational characteristics can be used in a conventional feed-back loop to apply a range correction to the range estimator 44. Appropriate stationary reference objects near the center of the target area are identified in a conventional manner by the evaluation device 52 at the beginning of the target acquisition period, and are then monitored to make sure that they maintain their position in the image memory 50 during the target acquisition period.

Figure 2A:
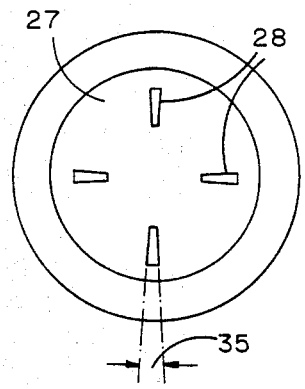
Figure 2B:
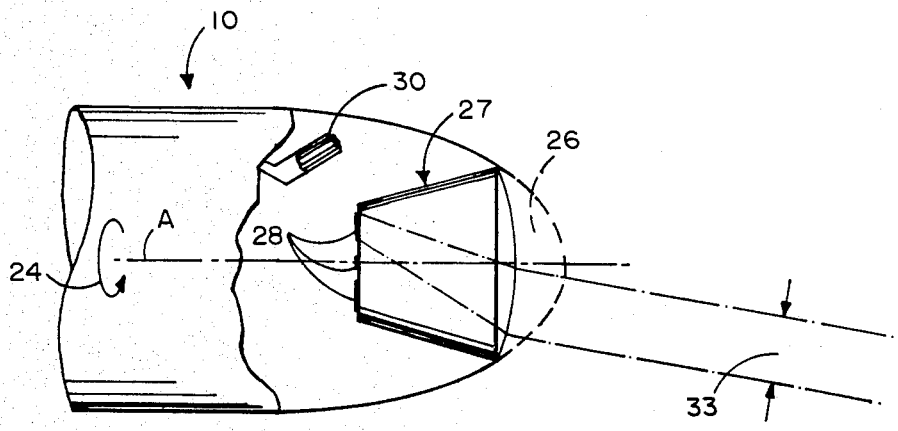

For maximum signal-to-noise ratio, the target information impinging upon the detectors 32, 34 is integrated (by virtue of the shape of the detector elements) over a period of time equal to the time required for the detector array to move through the distance d (FIG. 3) as a result of the spin of the projectile 10. In that manner, a constant infrared energy source will produce the same charge on any detector element observing it, regardless of its radial position within the array's radial field of view 33 (FIG. 2*b*). The integration period also corresponds to the time required for the array 28 to traverse its angular field of view 35 (FIG. 2*a*). In the event that constant angular resolution over the field of view is desired, the detector elements may be made rectangular instead of trapezoidal, at the expense of the constancy of the signal-to-noise ratio over the field of view.

As best shown in FIGS. 4 and 5, the detector arrays 28 mounted on the nose of the projectile 10 have a generally elliptical ring-shaped field of view 60, as the projectile 10 spins about its axis. Only a portion 62 of the field of view 60 is relevant to the guidance of the projectile. This is the target area, i.e. the portion in which the expected impact point 64 is centered. Consequently, each detector array 8 is activated only during the time in which it scans the target area 62. As the projectile approaches the target, the ground surface corresponding to the target area 62 becomes smaller and smaller. Simultaneously, reference objects 20, 21 and 22 appear to move radially outward (in the detector arrays' field of view) from the expected impact point 64.

If the compensation provided by the variation of the readout rate of CCD banks 36, 38 is correct, the reference objects 20, 21, 22 will appear to maintain their position within the image memory 50 in successive frames. The movement of a potential moving target 18 in the vicinity of the expected impact point 64 can then be detected by conventional subtractive comparison techniques in the evaluation device 52, and conventional guidance systems within the projectile can be activated to divert the projectile toward the moving target 18.

In the use of the inventive system, target acquisition is preferably commenced at a range of about 2 km, and is preferably ended at a range of about 1 km. At the beginning of this target acquisition period, the three objects nearest the expected impact point which can be assumed to be stationary are identified and become the reference objects which the system monitors for range correction. During the target acquisition period, the moving target nearest the expected impact point is identified. At the end of the target acquisition period, the system locks onto that target by virtue of its contrast alone, and activates conventional trajectory correction apparatus within the projectile to steer it toward the target.

Due to the non-linearity of the image growth, stationary objects near the fringe of the image will appear as false moving targets. However, inasmuch as the evaluation device 52 selects the target nearest the center of the image (i.e. the expected impact point), these false targets are inherently normally disregarded.

It will be seen that the present invention provides a simple self-contained system for identifying moving targets directly from a spinning projectile with a minimum of computation power, and without requiring any apparatus having moving parts.

I claim:

1. A method of moving target acquisition by a spinning body, comprising the steps of:

(a) using the spin of said body to scan an area ahead of the body, with a multi-element sensor fixed with respect to said body, to produce an image;

(b) sotring said image in pixel form;

(c) predicting, on the basis of pre-programmed expected trajectory information, position changes of stationary objects in said image in time-spaced frames of said scan due to optical growth of said image as a result of closing range;

(d) compensating for said position changes in such a way as to cause said objects to be imaged in the same pixel in time-spaced frames; and (e) identifying moving targets by their failure to be imaged in the same pixel in time-spaced frames.

2. The method of claim 1, in which said compensation is made on the basis of said expected trajectory information, and which further comprises the steps of:

(f) selecting a plurality of presumably stationary objects in said image;

(g) determining changes in the position of said stationary objects in said image in a plurality of frames spaced in time; and (h) using said position changes to modify said compensation basis.

3. The method of claim 1, in which said compensation is accomplished by reading image information out of said sensor at a variable rate, and storing said information at a generally fixed rate.

4. The method of claim 3, in which said variable rate is range-dependent, and said generally fixed rate is spin-dependent.

5. The method of claim 4, in which said compensation includes the steps of:

(i) individually temporarily storing, at said generally fixed rate, image information sensed by the individual elements of said sensor;

(ii) serially reading said temporarily stored information into a delay chain at said variable rate; and (iii) storing the contents of said delay chain at said generally fixed rate.

6. The method of claim 1, further comprising the step of:

(f) selecting the moving target nearest said expected impact point of said body.

7. A target acquisition system for spinning bodies, comprising:

(a) a body, and detection means mounted on said body so as to scan an arcuate target area including the expected impact point of said body;

(b) said detection means including an array of detector elements disposed so as to view radially adjacent segments of said target area;

(c) means for serially reading information detected by said detector elements out of said detection means at a variable rate;

(d) means for incrementally delaying said readout information at a fixed rate; and (e) memory means for periodically storing the information appearing at each increment of said delaying means in a memory location corresponding to that increment;

(f) said variable rate and said fixed rate being so related that stationary object information viewed by said detection means in stored in the same memory location in successive frames even though it is viewed by different detector elements in successive frames as a result of the body's motion toward said target area.

8. The system of claim 7, in which said detection means include:

(i) integrating means for enabling said detector elements, once for each line of the image, for a period of time sufficient to sweep through an angle generally equal to the field of view angle of said detectors; and (ii) charge-coupled device means connected to said detector elements for storing the charge accumulated by said detector elements during said period of time.

9. The system of claim 7, further comprising:

(g) rate control means for determining said variable rate in accordance with expected trajectory information; and (h) evaluation means connected to said memory means and said rate control means for recognizing said stationary object information and adjusting said variable rate if said information fails to be stored in said same memory location in successive frames.

10. The system of claim 7, further comprising geomagnetic sensing means connected to said detecting means so as to enable them only while said target area is within their field of view.

* * * * *